United States Patent [19]

Cochran

[11] 4,316,324

[45] Feb. 23, 1982

[54] AUXILIARY SLITTING BLADE FOR A CUTTING INSTRUMENT

[76] Inventor: Rex H. Cochran, 2003 Marietta Ave., Muscle Shoals, Ala. 35660

[21] Appl. No.: 103,111

[22] Filed: Dec. 13, 1979

[51] Int. Cl.[3] ..... B26B 11/00

[52] U.S. Cl. ..... 30/162; 30/287

[58] Field of Search ..... 30/125, 155, 158, 160, 30/161, 162, 143, 287, 294

[56] References Cited

U.S. PATENT DOCUMENTS

| | | | |
|---|---|---|---|
| 512,965 | 1/1894 | Hoyez | 30/161 |
| 689,513 | 12/1901 | Papendall | 30/158 |
| 3,791,033 | 2/1974 | Regan | 30/155 X |
| 3,906,627 | 9/1975 | Manning | 30/162 |

*Primary Examiner*—Jimmy C. Peters

*Attorney, Agent, or Firm*—T. Eugene Burts

[57] ABSTRACT

The apparatus comprises, in a knife, an auxiliary slitting blade carried in a recess in the butt end of the knife, the blade biased in a normally concealed position, with a reciprocally exposable cutting edge adapted to slitting in a transverse direction with limited penetration of the slitted surface.

3 Claims, 6 Drawing Figures

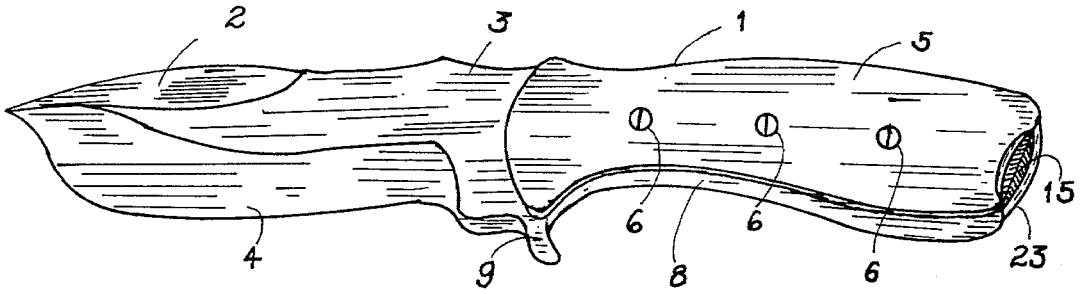
Fig. 1
Fig. 2
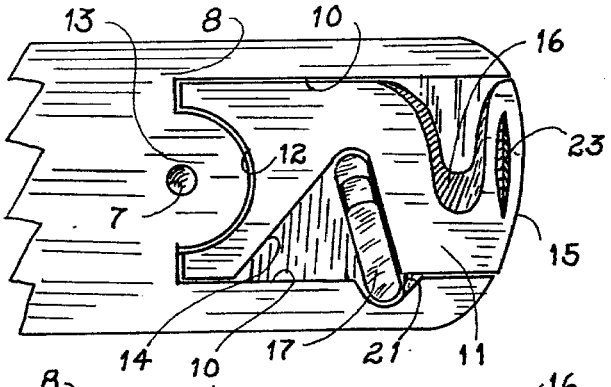
Fig. 3
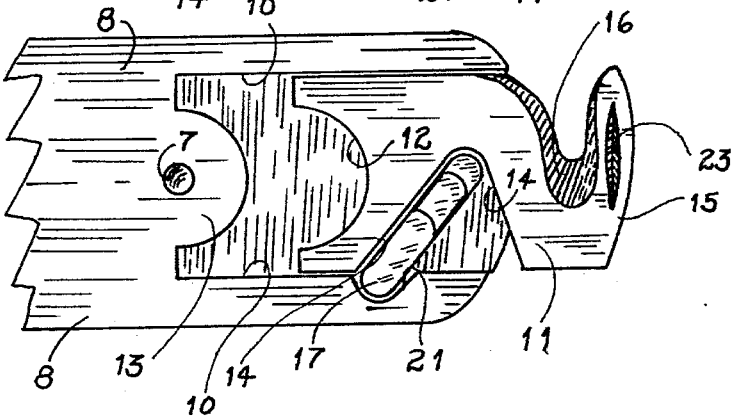
Fig. 4
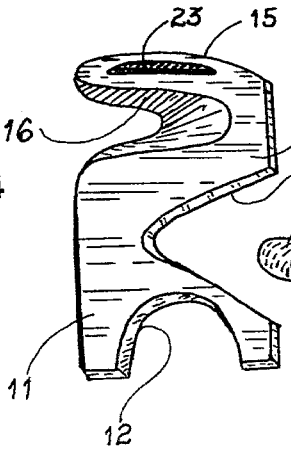
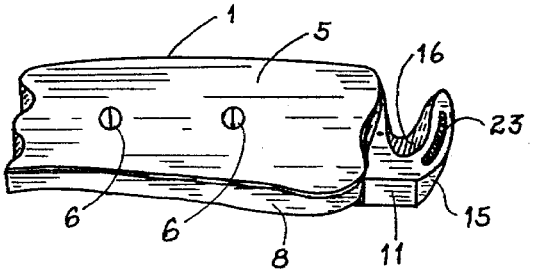
Fig. 6
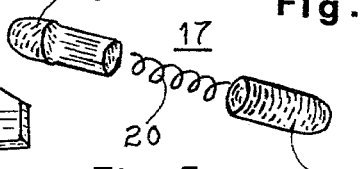
Fig. 5

AUXILIARY SLITTING BLADE FOR A CUTTING INSTRUMENT

BACKGROUND OF THE INVENTION

1. Field of the Invention

The invention relates in general to cutting instruments and it deals more particularly, in the embodiment shown, with a hunting knife which may be used to kill and to dress wild game, usually employed by one person acting alone without assistance in the dressing operation.

When wild game, such as deer, antelope, and the like, are dressed in the field the hunter is usually alone and it is necessary for him to perform this task as expeditiously as possible. He is usually carrying a hunting knife which he must use in connection with freeing the game from a trap or in the preliminary preparation of the game for dressing. These knives are usually heavy, with large blades, and are not easily handled for delicate jobs. Therefore, when it is necessary to slit open the skin of the game for the purpose of eviscerating the animal it is often necessary to change to a smaller and more specialized knife for this very delicate operation. For this purpose, it is usually necessary that one have a slitting hook or blade in the form of an extra knife; under conditions where it is not easy to lay aside one tool and grasp another in the performance of the job.

In the foregoing situation, it would be advantageous for the hunter to have attached to his regular hunting knife a separate tool to perform the slitting operation. However, this should be so attached that it would not be necessary to lay aside the main hunting knife and pick up the additional tool in this connection. It is desirable that a limited incision be made just under the surface of the skin and the incision carried from one end of the animal to the other for the eviscerating operation. To this end, it would be a very great advantage to have a tool wherein the depth of the incision was limited.

There are also other types of uses for a slitting tool of the type described in many industries performed by manual labor. It is necessary for an operator to use a rather large cutting tool for most of the operations until he reaches a point where a small object must be cut or slit without the danger of making a deep cut into the surface of the object. This sometimes occurs in operations where a person is opening large cartons with the large blade or large cutting surface of an instrument; and then it becomes necessary to make an opening in the carton with a limited penetration below the depth of the surface to be cut such that one will not injure the contents of the carton. It can readily be seen that this is also a field in which an auxiliary cutting or slitting blade could be employed in connection with a knife containing a large main blade.

A transverse slitting motion is most advantageous where the cutting is being done on a hanging object.

No existing equipment embodying these advantages as stated has been known up until this present invention.

2. Discussion of Prior Art

After a competent search, no existing devices of the type which are shown in this invention were found, there being six references which were considered, but which do not appear to conflict with the present invention or anticipate either the apparatus or the object and purposes for which it was designed. The prior art discloses the following U.S. patents:

Robert E. Manning, U.S. Pat. No. 3,906,627
G. W. Anderson, U.S. Pat. No. 3,363,315
A. B. Aciego, U.S. Pat. No. 2,845,706
L. Walters, U.S. Pat. No. 2,376,887
H. E. Crum, U.S. Pat. No. 1,748,637

Manning discloses a spinner's knife which is adapted to a particular use in the textile industry for engaging yarns, threads and the like, to sever the same. The user engages a blade by actuating a projection with his thumb, pushing the blade from a recess inside the handle to a position forward where the same is used to cut in a transverse direction. The principle object of this invention is simply to provide a cutting hook which can be pushed forward from a handle and which will snap back into place when not in use. It does not apply to providing an auxiliary blade in connection with a primary knife.

Anderson discloses a hunting knife having two folding blades which is adapted to dress wild game in the field. The use of this type of knife does not suggest in any way the adaptation in the present invention. This knife has two folding blades and, if the knife were grasped in the handle portion with one blade open for the purpose of using this blade for primary cutting and the other blade were simultaneously opened, an inadvertent movement of the hand could close the auxiliary or slitting blade on the fingers of the operator. It is also obvious that there is no suggestion of any limited penetration of the slitting blade into the surface being cut other than the restraint of the person using the knife. This patent does not suggest in any way the present invention.

The patent to Aciego discloses a cutting tool which is primarily adapted for cutting linoleum. This consists of a series of multiple cutting surfaces on each side of the projecting shank. There is no limitation as to the depth of the cut or slitting action and this would not be adaptable to the hunting knife type of use as shown in the present invention. This invention has a more specialized type of use and does not suggest the present invention.

Walters discloses a package cutter, with a spring release blade adapted for slitting purposes. This is a hand held guarded knife which would not be adapted for hunting purposes and is further not adapted for any other purpose other than the slitting operation for which it is obviously designed. This does not in any way suggest the double blade, double featured knife of the present invention.

Crum discloses a safety knife for an electrician having a recessed reciprocating blade which comes forward from the handle. This invention has both of the cutting surfaces on the same blade and therefore there is no limitation to the amount of penetration of the blade other than that caused by the restraint of the operator. It has a specialized use and therefore does not suggest the broad use of a general knife with a slitting blade as disclosed in the present invention.

The additional patent considered in the prior art in this case was the following: A. A. Podjaski, U.S. Pat. No. 2,589,128.

This invention discloses an improvement in a roofing knife attachment for a claw hammer. This is another specialized use tool which deals with a hammer rather than a knife. However, assuming that the end which contains the hammer head contained the blade of a hunting knife, the point of the blade would probably be directioned along the axis of the handle. Even if this were a knife, and the slitting blade 19 was projected laterally as shown, the direction of cut would be coaxial with the direction of the handle and blade of the knife, thereby placing a portion of the hand of the operator against the surface being cut. This is exactly what is avoided in the present invention where the hand of the operator is out of the way and the cutting is done in a direction transverse to the axis of the handle. There is no suggestion in this patent of the present invention.

SUMMARY AND OBJECTS OF THE INVENTION

The present invention relates to cutting instruments, and it deals more particularly with a type such as used for primary heavy cutting with an auxiliary blade for a specialized slitting or cutting to a desired depth.

A particular embodiment of this invention is shown in a hunting and dressing knife with a main blade and a separate blade for shallow slitting to desired depth for eviscerating game.

A primary object, therefore, is to provide a knife with a heavy cutting blade, but having a normally concealed or sheathed ancillary blade for special cutting operations.

In this connection, it is a salient feature to provide a knife which can be easily used in one hand and provide convenient exposure of the auxiliary blade without the necessity of changing hands.

A further salient feature is to provide a knife which affords an easily accessible auxiliary slitting blade which can be employed in a transverse cutting movement without changing hands or without the hand of the operator getting in the way of the cutting motion.

At the same time, it is a primary object to provide a slitting blade adapted to insure a desired penetration limited to that necessary for the task.

BRIEF DESCRIPTION OF THE DRAWINGS

FIG. 1 is a plan view, partially in perspective, of the knife of the invention.

FIG. 2 is a cutaway portion of the handle of the knife, with the handle plates removed to show the inside structure of the slitting blade when retracted.

FIG. 3 is a fractional view of the handle, partially cut away, with the handle plate removed to show the inside structure of the slitting blade as it appears extended.

FIG. 4 is a plan view, partially in perspective, of the slitting blade structure.

FIG. 5 is a perspective view of the spring capsule assembly.

FIG. 6 is a partial broken view of the handle of the knife with the slitting blade extended.

DETAILED DESCRIPTION OF THE INVENTION

Referring more particularly to the drawings, FIGS. 1 through 6 show a modified version of the invention as adapted to a hunting knife.

Referring to FIG. 1, we can see that the invention comprises a hunting knife having a handle 1 attached to a heavy blade 2, which has a shank 3 extending back under the handle plate 5.

The blade 2 has a sharpened edge 4, and between the shank extension 8 and the sharpened portion of the blade there is formed a blade guard 9.

Referring to FIGS. 2 and 3, it can be seen that the handle plat 5 is maintained in position by means of screws 6 which are received by holes 7 in the shank extension 8.

The shank extension 8 is provided with an inset receptacle chamber or cavity 10 adapted to receive the guide shank 11 of a slitting blade 15, said shank being provided with a curved groove 12 adapted to receive the tongue 13 of the shank member. The guide shank 11 is provided with a bias notch 14 on its underside which registers with the saddle notch 21 in the lower surface of the receptacle chamber 10 such that the same is adapted to receive the spring capsule 17.

As can be readily seen from FIGS. 2, 3 and 4, the guide shank 11, has its outer end curved and sharpened to provide a parabolic cutting edge 16 which faces the upper portion of the knife surface and forms the major body of the slitting blade, designated as 15, in which there is provided a knurled notch 23 to allow movement of this member in a reciprocal direction by means of use of a finger nail.

Referring to FIG. 5, the spring capsule, generally designated as 17, comprises an upper half 18 formed to provide a depending shaft of lesser diameter adapted to fit into the opening channel of the lower half 19, and bias in an outwardly direction by means of the spring 20.

The capsule 17 will assume different lengths depending upon the position of the guide shank 11 in the chamber 10, whether the blade is in the extended or retracted position. It will be noted that the spring capsule 17 rides in the bias notch 14 with its upper end against the upper forward wall of the notch 14 when the blade and guide shank are in the retracted mode as shown in FIG. 2. The lower end of the capsule rides in the saddle notch 21 under these conditions with the spring assembly constantly biasing the upper end of the capsule 17 against the forward wall of the notch 14 maintaining the shank 11 and blade 15 in the inwardly retracted position.

When the mechanism is actuated, by means of pulling on the notch 23 with a thumbnail, the guide shank 11 extends outwardly against the biasing effect of the spring 17 allowing the blade 15 to be extended as shown in FIG. 3. In this position the spring capsule 17 rides in the saddle 21 with its upper end against the rear wall of the guide shank 11, biasing the guide shank and blade in the outward extended position as shown in FIG. 3.

Generally, with the blade retracted the knife would appear as shown in FIG. 1, while with the blade extended, the rear end of the knife would appear as shown in FIG. 6.

An important feature of the invention resides in the fact that with the blade extended, as in FIG. 3, it will be noted that the sharpened edge of the blade 16 forms an inverted parabolic curve the inner edge of which corresponds with the outer face of the butt end of the knife handle as indicated. Since the projection of the blade 15 is constant by means of the spring capsule 17 riding in the notch 14, this indicates that a cut can be made only to the depth of the amount of the blade extending beyond the butt end of the handle and the depth of penetration of the blade is thus thereby limited.

The limitation of the penetration of the slitting blade is very important when it is used in eviscerating wild game. It is desired to make a shallow incision in the abdomen of the game in order that the contents may be properly ejected.

It can readily be seen from the embodiment of the invention that the slitting blade in FIGS. 1 through 6 can be actuated by means of the fingernail of one hand to extend the slitting blade beyond the butt end of the knife restricted in its projection by means of the spring capsule 17 and limiting the amount of penetration of the slitting blade as the surface of the object slitted passes against the surface of the butt end of the handle. The slitting blade may be closed in this instance by the use of the hand or by tapping the knife against some object. It can be seen that the slitting motion is transverse to the axis of the handle and therefore the hand does not get in the way of the cutting motion during slitting. I have achieved a totally concealed slitting blade which has means for exposing the blade by the use of one hand, and the blade as so modified allows cutting in a direction transverse to the axis of the handle with a limited penetration into the surface to be slitted.

The same adaptation of the invention shown in FIGS. 1 through 6 to accomodate a knife having a folding blade could be made by merely shifting the size and location of the receptacle chamber upward in the handle, leaving the lower portion of the handle to receive a folding blade.

It will be readily apparent that the modification of my invention is well adapted to meet all of the objects and ends of this invention. Thus it will be seen that we have provided an apparatus suitably adapted to meet the objects and features hereinbefore set forth.

From the foregoing, it will also be seen that the invention is well adapted to the use mentioned as well as to other uses and to attain all of the ends and objects, together with other advantages which are obvious and which are inherent to the structure.

It will be understood that certain features of any subcombination of the invention are of utility and may be employed without reference to other features and subcombinations. This is contemplated by and is within the scope of the claims. As many possible embodiments of the invention may be made without departing from the scope thereof, it is to be understood that all matters set forth or shown in the drawings are to be interpreted as illustrative and not in a limited sense.

Having thus described the invention, what is claimed is:

1. In a knife having a blade with an extended shank portion covered by a handle, a retractable auxiliary slitting blade comprising, in combination:

a recessed axially disposed receptacle chamber in said handle having a lengthwise elongated bore channel extending inwardly from the butt end of said handle;

a correspondingly shaped elongated guide shank for an auxiliary blade disposed movably lengthwise in said channel and having at its outer end a formed slitting blade with a generally parabolic configuration disposed with an inwardly directed cutting edge transverse the longitudinal axis of said shank and receivable by said channel;

corresponding receptacle notch cavities in said channel and guide shank;

an incapsulated telescoping compression spring received in the seats of said cavities, respectively, movably operable directionally with the reciprocal motion of said guide shank to impinge said spring capsule on the opposing sides of said notch cavities to alternately urge said shank in the retracted and in the exposed mode with limited penetration of said blade relative to the surface to be cut by the distance of the projection of said blade beyond said handle;

and gripable activating surfaces on said blade to selectively expose and retract the same.

2. In a knife having a blade with an extended shank portion covered by a handle, a retractable auxiliary slitting blade comprising, in combination:

a recessed axially disposed receptacle chamber in said handle having a lengthwise elongated bore channel extending inwardly from the butt end of said handle;

a correspondingly shaped elongated guide shank for an auxiliary blade disposed movably lengthwise in said channel and having at its outer end a formed slitting blade with an inwardly directed cutting edge transverse the longitudinal axis of said shank;

mounting means on said receptacle chamber and guide shank comprising corresponding opposing receptacle cavities in said channel and guide shank;

biasing means received in said opposing receptacle cavities movable operable directionally to alternately, limited by impingement on said cavity surfaces, urge said guide shank in the blade retracted position and in limited penetration in the blade exposed position.

3. In a knife with an auxiliary blade as in claim 2, the combination wherein said biasing means comprises:

a compression spring member in said receptacle cavities disposed directionally restricted by interacting stop contacts on said shank cavity and channel cavity, alternately urging said shank in the blade retracted and the blade exposed conditions.

* * * * *